US008292337B2

(12) United States Patent
Chang

(10) Patent No.: US 8,292,337 B2
(45) Date of Patent: Oct. 23, 2012

(54) DEVICE FOR CONTROLLING A DOOR

(75) Inventor: Tsung-Chih Chang, Shanghai (CN)

(73) Assignee: Shanghai One Top Corporation, Shaghhai (CN)

( * ) Notice: Subject to any disclaimer, the term of this patent is extended or adjusted under 35 U.S.C. 154(b) by 0 days.

(21) Appl. No.: 12/094,642

(22) PCT Filed: Nov. 17, 2006

(86) PCT No.: PCT/AU2006/001725

§ 371 (c)(1),
(2), (4) Date: Jul. 29, 2008

(87) PCT Pub. No.: WO2007/059556

PCT Pub. Date: May 31, 2007

(65) Prior Publication Data

US 2008/0290669 A1 Nov. 27, 2008

(30) Foreign Application Priority Data

Nov. 25, 2005 (AU) ..... 2005906600
Aug. 29, 2006 (AU) ..... 2006904704

(51) Int. Cl.
*E05C 17/56* (2006.01)

(52) U.S. Cl. ..... 292/251.5; 70/277

(58) Field of Classification Search ..... 292/251.5; 340/686.1, 5.7; 70/277, 333 R
See application file for complete search history.

(56) References Cited

U.S. PATENT DOCUMENTS

| | | | | |
|---|---|---|---|---|
| 4,257,631 | A * | 3/1981 | Logan, Jr. | 292/251.5 |
| 4,652,028 | A * | 3/1987 | Logan et al. | 292/251.5 |
| 4,703,962 | A | 11/1987 | Kelly et al. | |
| 4,763,937 | A * | 8/1988 | Sittnick et al. | 292/251.5 |
| 4,871,204 | A * | 10/1989 | Cook et al. | 292/251.5 |
| 4,915,431 | A | 4/1990 | Bailey | |
| 5,141,271 | A | 8/1992 | Geringer et al. | |
| 5,709,421 | A | 1/1998 | Gillham | |
| 6,609,738 | B1 | 8/2003 | Roth et al. | |
| 7,113,092 | B2 * | 9/2006 | Keene | 340/551 |
| 7,319,383 | B2 * | 1/2008 | Howard | 340/531 |
| 2005/0237214 | A1 * | 10/2005 | Sanchirico et al. | 340/686.1 |

FOREIGN PATENT DOCUMENTS

WO 99/63188 12/1999

OTHER PUBLICATIONS

International Search Report; PCT/AU2006/001725.

* cited by examiner

*Primary Examiner* — Carlos Lugo
*Assistant Examiner* — Mark Williams
(74) *Attorney, Agent, or Firm* — Ladas & Parry LLP

(57) ABSTRACT

A device for controlling a door, the device having: a body; an electromagnet arranged to generate a magnetic field for retaining the door; a coupling that couples the electromagnet to the body, the coupling being arranged to allow a movement of the electromagnet relative to the body; and a current supply that is arranged to supply the electromagnet with a current. The current supply is arranged to detect the movement of the electromagnetic and to cease supplying the current at a predetermined instant after detecting the movement of the electromagnet.

13 Claims, 7 Drawing Sheets

DEVICE FOR CONTROLLING A DOOR

FIELD OF THE INVENTION

The present invention relates generally to the field of controlling a door, and more particularly—but by no means exclusively—the field of controlling the ability to open the door.

BACKGROUND OF THE INVENTION

The ability to control the opening of a door can be highly desirable. For instance, the ability to prevent an emergency exit door of a public building (such as a shop) from being readily opened can be desirable for security reasons. While there exists many door locking mechanisms that could be used to control the opening of the door, existing door locking mechanisms can be unsuitable in some situations because they do not meet building safety requirements. More specifically, existing door locking mechanisms will commonly only release the door for opening if the appropriate key is used to unlock the mechanism. In this regard, some building safety standards require door locking mechanisms to release the door without a key so that it can be opened relatively easily.

SUMMARY OF THE INVENTION

According to a first aspect of the present invention there is provided a device for controlling a door, the device comprising:

a body;

an electromagnet arranged to generate a magnetic field for retaining the door;

a coupling means that couples the electromagnet to the body, the coupling means being arranged to allow a movement of the electromagnet relative to the body; and a current supply means that is arranged to supply the electromagnet with a current, the current supply means being further arranged to detect the movement of the electromagnet and to cease supplying the current at a predetermined instant after detecting the movement of the electromagnet.

An advantage of an embodiment of the device is that it enables the opening of the door to be controlled in a manner that accords with a building safety requirement to allow the door to be opened without a key. Of particular note is the fact that the embodiment of the device retains the door in a closed position for a predetermined extent of time, after which the embodiment of the device releases the door so that it can be opened. This advantage is provided by virtue of the fact that the embodiment of the device is capable of detecting the movement of the electromagnet and cease supplying the current at the predetermined instant after detecting the movement of the electromagnet.

Preferably, the device further comprises a visual indicator arranged to provide a particular visual indication when the electromagnet is generating the magnetic field.

An advantage of incorporating the visual indicator into the embodiment of the device is that it effectively provides a means for enabling persons (such as security staff) to readily discern whether the door is being retained by the device.

Preferably, the body comprises:

an elongate section that defines a void; and elements that extend outwardly from opposed surfaces of the elongate section and into the void, wherein the coupling mean and the electromagnet are located in the void.

Preferably, the coupling means comprises:

a base that is retained in position by the elements;

a component that is secured to the main part and which is attached to the base; and a resilient part disposed between the base and a head of the component, the resilient part being such that it enables the movement of the electromagnet.

Preferably, the current supply means comprises:

an electronic circuit that has a switch; and a lug that is attached to the electromagnet, wherein the electronic circuit and the lug are arranged such that the movement of the electromagnet causes a change in a state of the switch, which in turn causes the electronic circuit to cease supplying the current at the predetermined instant.

Preferably, the current supply means also comprises an adjustable portion that can be adjusted so as to set an amount of the movement of the electromagnet that causes the change in the state of the switch.

Preferably, the device further comprises an image capture means arranged to capture an image subsequent to the current supply means detecting the movement of the electromagnet.

An advantage of an embodiment of the device including the image capture device is that the device can, for example, capture an image of a person attempting to open the door.

Preferably, the device further comprises a sound emitting means arranged to emit a sound subsequent to the current supply means detecting the movement of the electromagnet.

An advantage of an embodiment of the device including the sound emitting means is that by emitting the sound it can cause the person to look at the device, which in turn enables the image capture device to capture a better image of the person's face.

Preferably, the device further comprises an audio recording means for recording audio information subsequent to the current supply means detecting the movement of the electromagnet.

An advantage of an embodiment of the device including the audio recording means is that it enables the device to record audio (voices) from persons in the vicinity of the door.

Preferably, the device further comprises a radio frequency transmitter that is arranged to transmit a radio signal encoded with the image captured by the image capture means and/or the audio information recorded by the audio recording means.

According to a second aspect of the present invention, there is provided a door locking device comprising:

an electromagnet for retaining a door armature plate; and a visual indicator means arranged to provide a particular visual indication when the electromagnet is retaining the door armature plate.

BRIEF DESCRIPTION OF THE DRAWINGS

Notwithstanding any other embodiments that may fall within the scope of the present invention, an embodiment of the present invention will now be described, by way of example only, with reference to the accompanying figures, in which:

FIG. 1(*b*) provides another illustration of the device depicted in FIG. 1(*a*);

FIG. 1(*c*) provides a further illustration of the device depicted in FIG. 1(*a*);

FIG. 1(*d*) provides yet another illustration of the device depicted in FIG. 1(*a*);

FIG. 1(*e*) provides a further illustration of the device depicted in FIG. 1(*a*);

FIG. 1(*f*) provides another illustration of the device depicted in FIG. 1(*a*);

FIG. 1(*g*) is yet a further illustration of the device depicted in FIG. 1(*a*);

FIG. 2(*b*) shows the device of FIG. 2(*a*) in another position; and

FIG. 2(*c*) shows the device of FIG. 2(*a*) in yet another position.

AN EMBODIMENT OF THE INVENTION

Figure 1A:
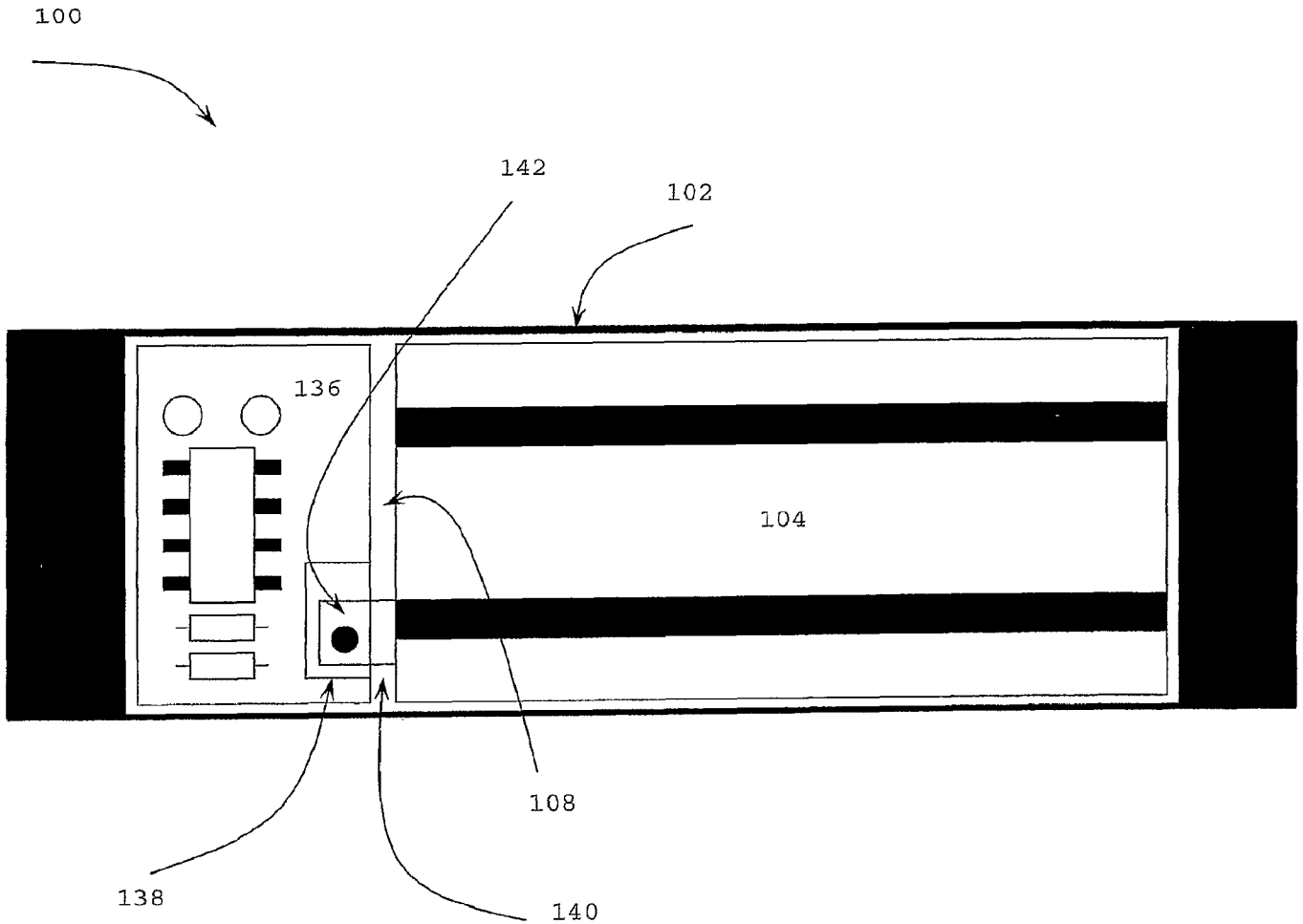
FIG. 1(*a*) provides an illustration of a device in accordance with an embodiment of the present invention.
Figure 1:
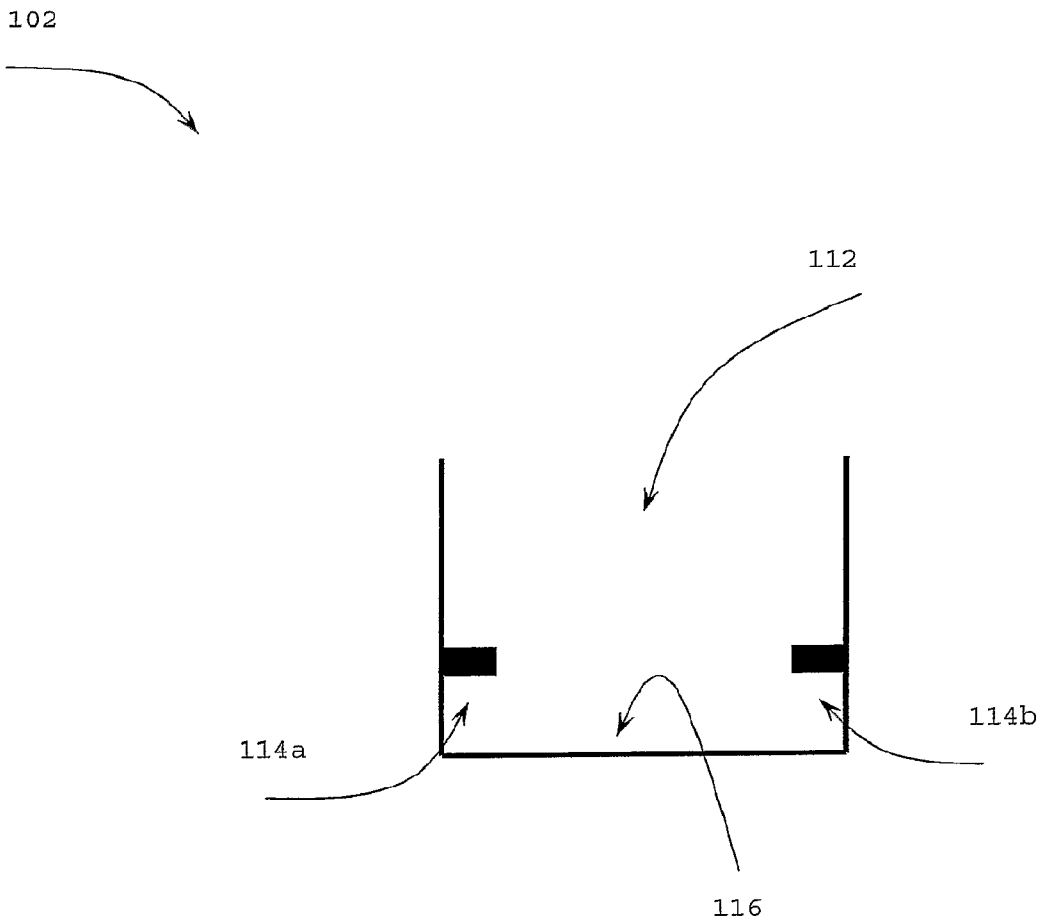
Figure 1C:
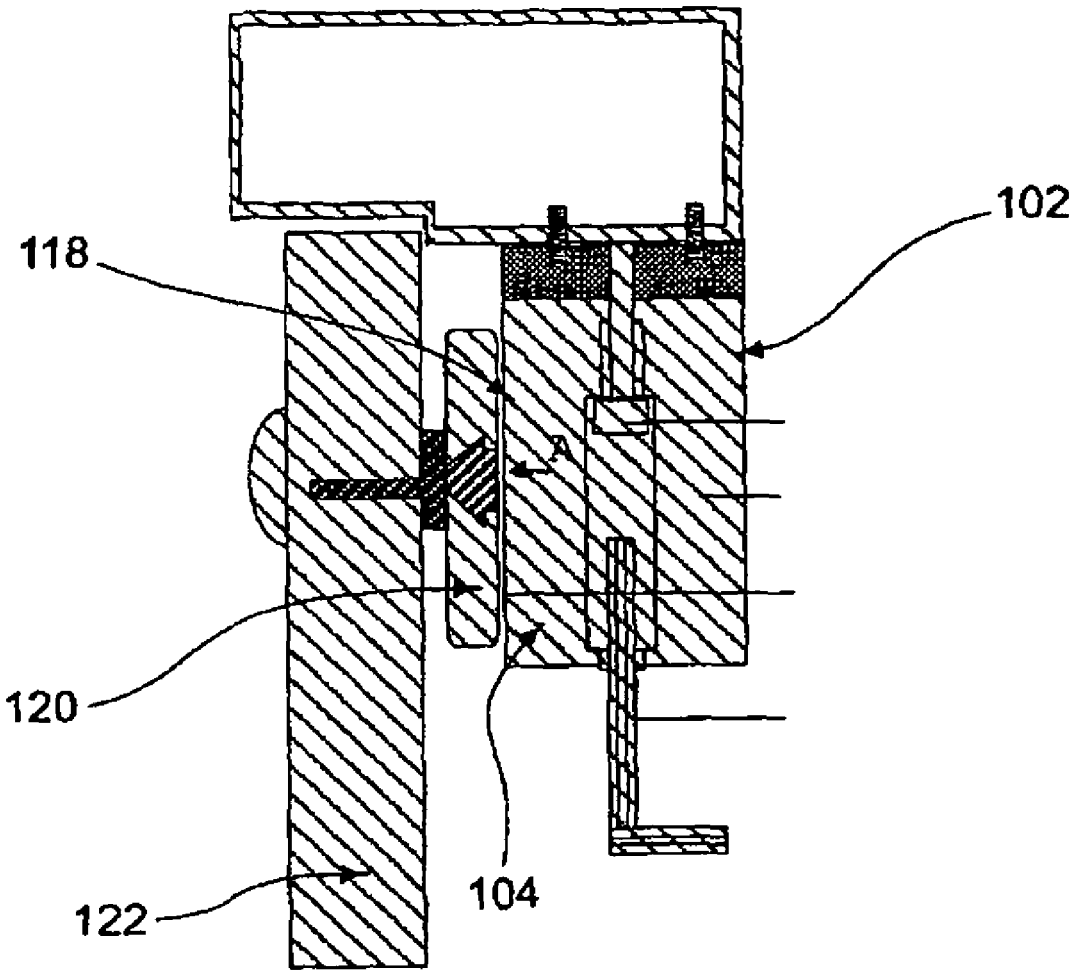
Figure 1D:
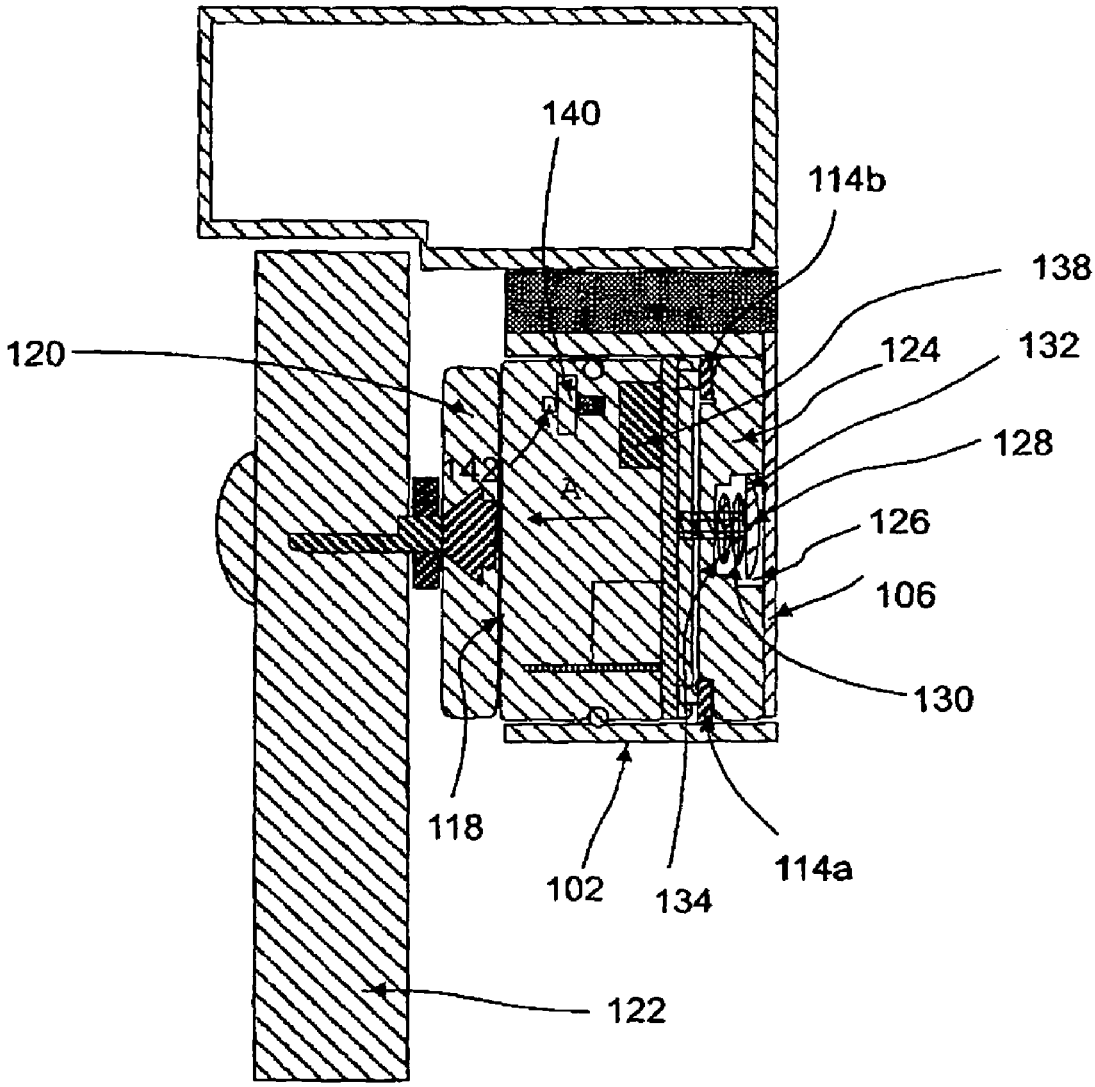
Figure 1E:
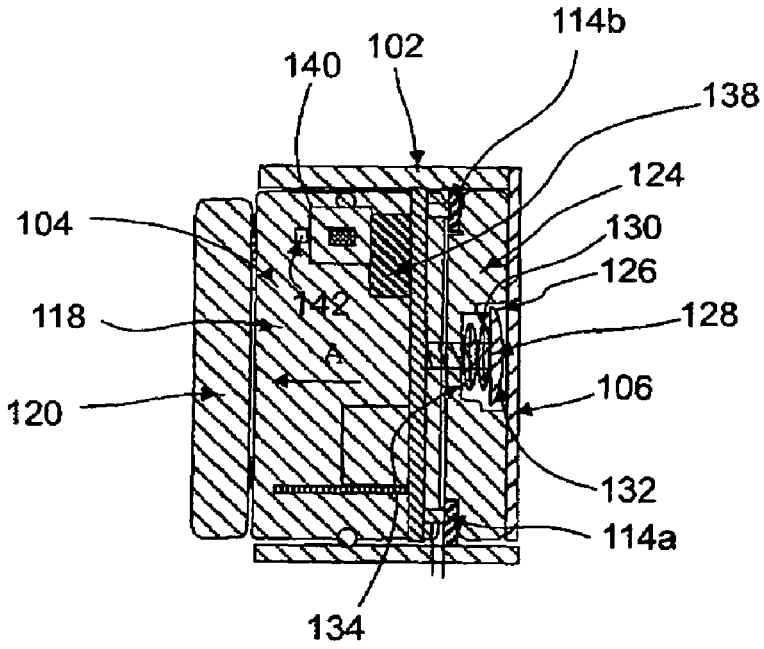
Figure 1F:
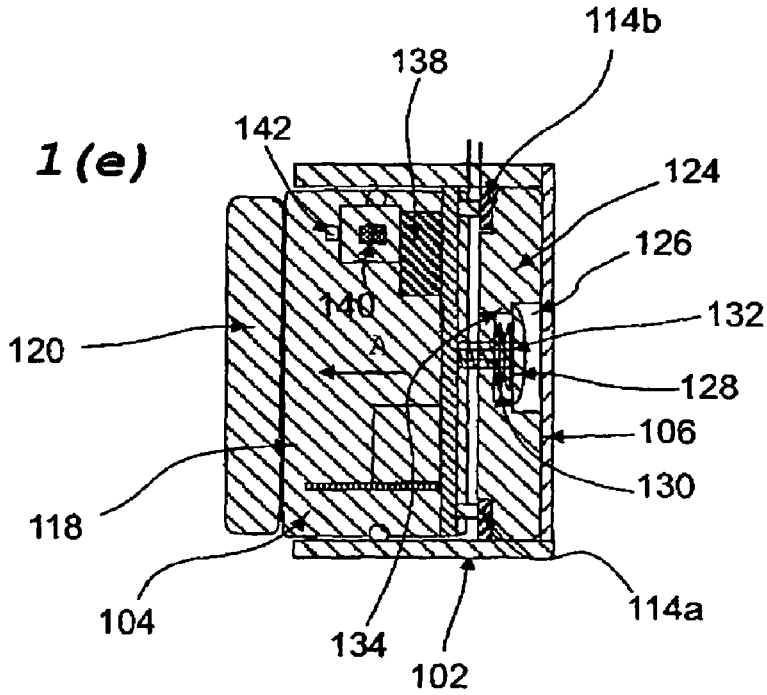
Figure 1G:
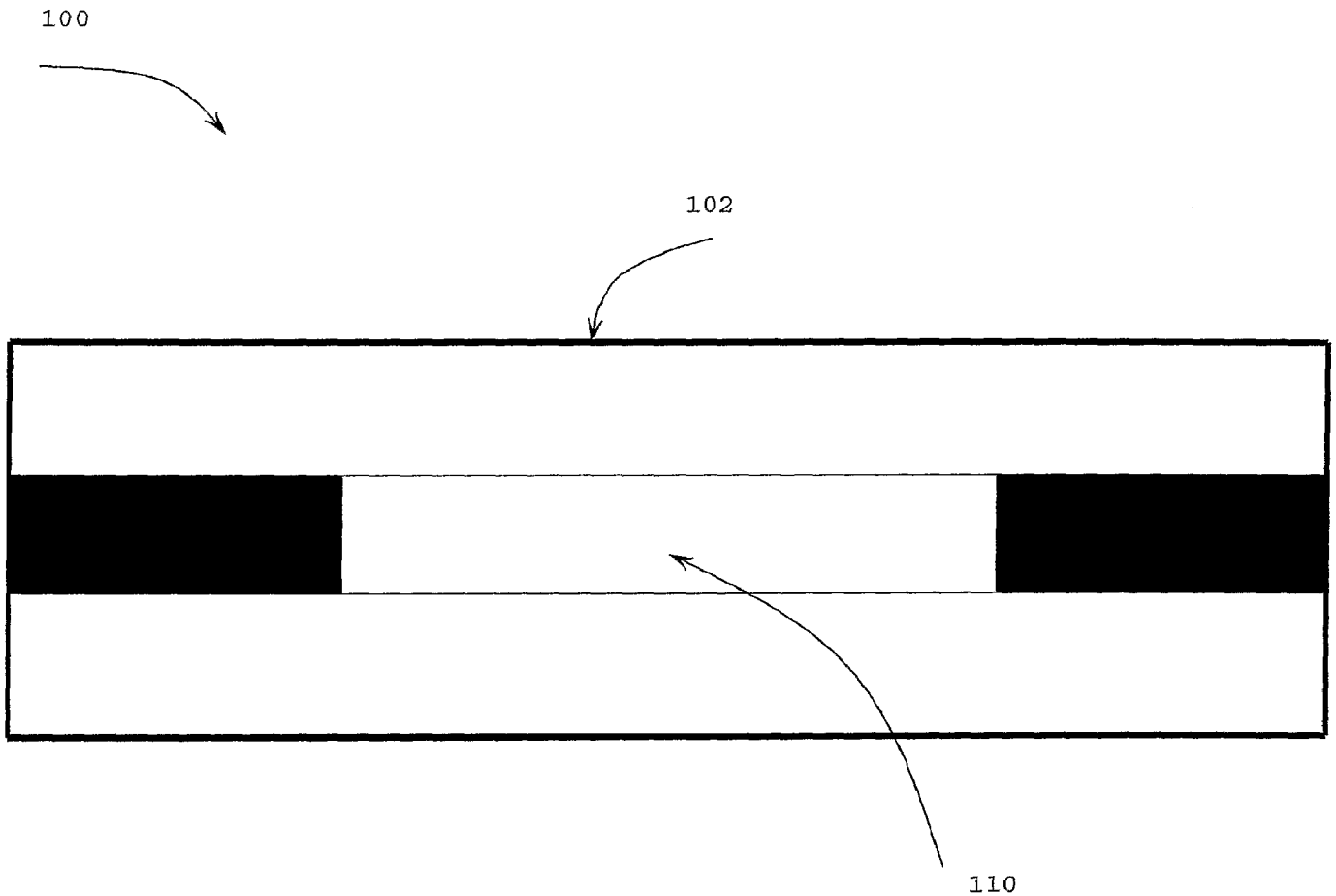

With reference to FIG. 1(*a*), a device 100 in accordance with an embodiment of the present invention comprises a body 102; an electromagnet 104; a coupling means 106, which can be viewed in FIG. 1(*d*); and a current supply means 108; and a visual indicator 110, which can be seen in FIG. 1(*g*).

With reference to FIG. 1(*b*), the body 102 is in the form of an elongate section that defines a void 112 and which is made from aluminium. It will be appreciated by persons skilled in the art that other embodiments of the present invention the body 102 can be made from a material other than aluminium such as, for example, steel. The body 102 has a U-shaped cross profile and has two elements 114 that project outwardly from an inner surface 116 of the body 102 and into the void 112 defined thereby. As described in more detail in subsequent paragraphs of this specification, the elements 114 are used to retain the coupling means 106 in the void 112. As can be seen in FIG. 1(*e*), the body 102 is attached to a door frame 117 in the doorway. The body 102 is attached to the door frame 117 by screws.

With reference to FIG. 1(*d*), the electromagnet 104 is located in the void 112 of the body 102. As persons skilled in the art will readily appreciate, the electromagnet 104 is arranged to generate a magnetic filed as a current passes through the electromagnet 104. As discussed in more detail in subsequent paragraphs of this specification, the electromagnet 104 receives a supply of the current from the current supply means 108 (which is shown in FIG. 1(*a*)). The electromagnet 104 has a face 118 that protrudes from the void 112 of the body 102. The face 118 is relatively flat and is arranged to be in abutment with a metal armature plate 120 that is attached to a door 122. The electromagnet 104 is such that it securely retains the metal armature plate 120 when the armature plate 120 is in abutment with the face 118 and the electromagnet 104 is generating the magnetic field. By securely retaining the metal armature plate 120 the electromagnet 104 is capable of holding the door 122 in a closed position.

As described previously, the electromagnet 104 is located in the void 112 of the body 102. It is the coupling means 106 that holds the electromagnet 104 securely in the void 112. As can be seen in FIG. 1(*d*), the coupling means 106 comprises a base 124 that is held in position by the elements 114 of the body 102. The base 124 is made from a plastic material, but could well be made from another material, such as non-ferrous metal, in an alternative embodiment of the present invention. The base 124 comprises a recess 126.

In addition to the base 124 the coupling means 106 comprises at least one component 128 that resides in the recess 126. The component 128 is essentially a screw-type device, which extends through the base 124 and into the electromagnet 104 to thereby secure the electromagnet 104 in the void 112 of the body 102. The coupling means 106 also comprises a resilient part 130 that is located between a head 132 of the component 128 and a base 134 of the recess 126 in the base 124. The resilient part 130, which is made of a rubber material (or plastic in an alternative embodiment), allows the electromagnet 104 to be moved relative to the body 102 in the direction indicated by arrow "A". The amount of movement permitted by the coupling means is illustrated in FIG. 1(*e*) and FIG. 1(*f*). The electromagnet 104 typically moves in the direction indicated by arrow "A" when the armature plate 120 attached to the door 122 is secured to the face 118 of the electromagnet 104 when it is generating the magnetic field and when a force in the direction of arrow "A" is exerted on the door 122, which occurs when persons try to open the door 122.

Referring to FIG. 1(*a*), the current supply means 108 comprises an electronic circuit 136. The electronic circuit 136 is essentially arranged to be connected to a 12 volt DC power source (or any other suitable voltage) and to provide the electromagnet 104 with the supply of current necessary for it to generate the magnetic field. The electronic circuit 136 consists of various electronic components including, for example, a voltage regulator, resistors and capacitors. One of the notable components is a micro-switch 138. The micro-switch 138 is a single pole double throw (SPDT) arrangement. The actuator of the micro-switch 138 is capable of being moved from a first position to a second position. The electronic circuit 136 is arranged such that when the actuator of the micro-switch 138 is in the first position the electronic circuit 136 is such that it provides the supply of the current to the electromagnet 104. However, the electronic circuit 136 is such that when the actuator of the micro-switch 138 is moved from the first position into the second position the electronic circuit 136 ceases supplying the current to the electromagnet after a predetermined period of time has elapsed. Typically, the electronic circuit 138 will cease supplying the current after approximately 5 seconds. It is noted that the electronic circuit 136 includes a Dual In-line Package (DIP) switch (not shown in the figures), which can be set by a person to adjust the predetermined period of time as required.

In addition to the electronic circuit 136, the current supply means 108 includes a lug 140 that is attached to the electromagnet 104. The lug 140 includes an adjustable portion 142 in the form of a grub-screw, which can be screwed up and down relative to the lug 140. The lug 140 is attached to the electromagnet 104 at a position near the micro-switch 138 such that movement of the electromagnet 104 in the direction indicated by the arrow marked "A" cases the actuator of the micro-switch 138 to be moved from the first position to the second position. In this regard, the adjustable portion 142 can be set (screwed) to set the amount of movement of the electromagnet 104 that causes the actuator of the micro-switch 138 to be moved from the first position to the second position.

In relation to the visual indicator 110, which can be seen in FIG. 1(*g*), this feature of the device 100 is used to provide a visual indication of whether the metal armature plate 120 attached to the door 122 is secured to the face 118 of the electromagnet 104 by the magnetic field generated thereby, More specifically, the visual indicator 110 is arranged to emit light of a first colour when the metal armature plate 120 attached to the door 122 is secured to the face 118 of the electromagnet 104 by the magnetic field generated thereby, and light of a second colour when the metal armature plate 120 attached to the door 122 is not secured to the face 118 of the electromagnet 104 by the magnetic field generated thereby; that is, the electromagnet is not generating the magnetic field. The visual indicator 110 is electrically connected to the electronic circuit 136. The visual indicator 110 is in the form of at least one Light Emitting Diode (LED).

While not shown in the accompanying figures, it is envisaged that alternative embodiments of the device 100 include addition features that enhance the security aspects of the device 100. One of the addition features is a CCD camera that is electrically coupled to the current supply means 108. On detecting movement of the electromagnet 104 the current supply means 108 activates the CCD camera in order to cause it to capture an image of the area near the door 122. Typically, the usage (which may be either a single shot or short video clip) will capture persons trying to open the door 122.

To ensure the CCD captures suitable images of persons trying to open the door 122, the device 100 also includes (in an alternative embodiment) a sound emitting circuit. The sound emitting circuit is also coupled to the current supply means 108, which is arranged to activate the sound emitting circuit on detecting movement of the electromagnet. On being activated, the sound emitting circuit emits a sound. By emitting the sound persons in the vicinity of the door 122 will be caused to look at the device 100, which in turn allows the CCD camera to capture a good image of the persons' face.

In addition to the CCD camera and the sound emitting circuit, it is envisaged that the alternative embodiment of the device 100 includes a digital audio recording circuit for recording the voices of persons in the vicinity of the door 122. In this regard, the digital audio recording circuit is electrically coupled to the current supply means 108. The current supply means causes the audio recording circuit to be activated to thereby record the voices of persons located near the door 122.

It is also envisaged that in an alternative embodiment the device 100 also includes a radio frequency transmitter circuit, which is arranged to receive the image captured by the CCD camera and the audio information recorded by the digital audio recording circuit. On receiving the image and the audio information the radio frequency transmitter circuit transmits a radio frequency signal that is encoded with the image and the video information. The transmitted radio frequency signal can be received and processed at a security console.

Figure 2:
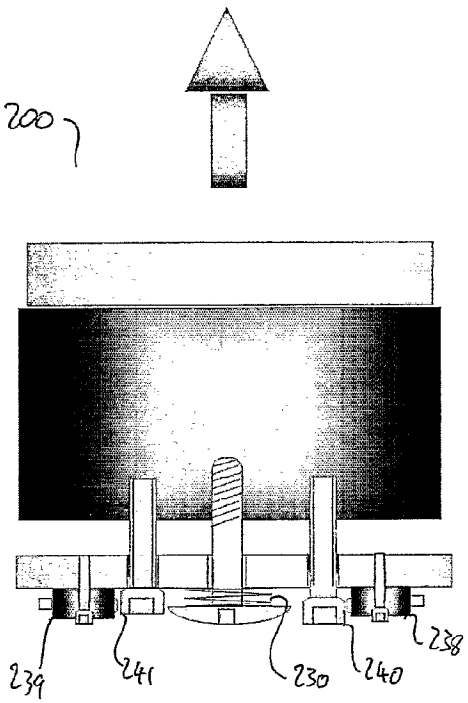
FIG. 2(*a*) shows an alternative embodiment of the invention.
Figure 2:
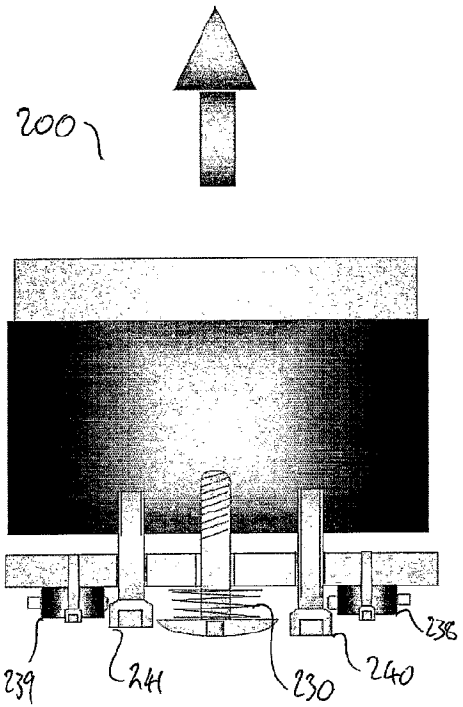
Figure 2:
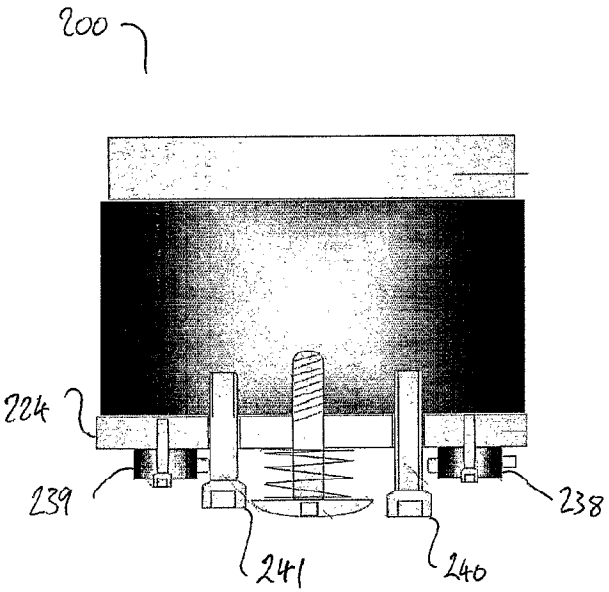

Referring to FIG. 2(*a*), an alternative embodiment of the invention is shown. In this version two microswitches 238, 239 are used. The microswitches are actuated by the heads of actuation screws 240, 241. The depth of insertion of each of screws 241, 240 into plate 224 dictates the force required to actuate either of microswitches 239, 240.

Referring to FIG. 2(*b*), a moderate force is being applied to device 200 which is comparable to the force that might be applied by a person attempting to push open a door. The force is balanced by compression of spring 230. It can be seen that microswitch 239 has become actuated by the head of actuation screw 241.

Referring to FIG. 2(*c*), a large force is being applied to device 200 which is comparable to the force that might be applied by a person attempting to force open a door. The force is balanced by further compression of spring 230. It can be seen that microswitch 238 has become actuated by the head of actuation screw 240.

Device 200 includes a radio transmitter device which can transmit signals indicating a condition of device 200 based on the positions of microswitches 239, 240. If neither switch is actuated then this indicates that the door is not being pushed.

If switch 239 is actuated then this indicates that somebody may be attempting to open the door. The radio transmitter circuit may transmit a signal indicating this. This may be received at a local unit which sounds an alarm to indicate to the person that the door is locked.

If switches 239 and 240 are actuated then this indicates that somebody may be making a forced attempt to break open the door. The radio transmitter circuit may transmit a signal indicating this. This may be received at a remote security console or the like to indicate to security personnel that a forced attempt may be being made to open the door to which device 200 is attached.

Any reference to prior art contained herein is not to be taken as an admission that the information is common general knowledge, unless otherwise indicated.

Finally, it is to be appreciated that various alterations or additions may be made to the parts previously described without departing from the spirit or ambit of the present invention.

The invention claimed is:

1. A device for controlling a door, the device comprising;

a body;

an electromagnet coupled to the body by a coupling device such that the electromagnet is movable via a coupling means between a first position and a second position relative to the body, and the electromagnet arranged to generate a magnetic field for releasably coupling a magnetic element mounted to the door to the electromagnet so as to retain the door in a closed position when the magnetic element is in abutment with the electromagnet and the electromagnet generates the magnetic field, wherein movement of the door from the closed position towards an opened position also moves the electromagnet via a coupling means from a first to a second position relative to the body, a microswitch having an actuator, wherein movement of the electromagnet from the first to the second position, also moves the actuator of the microswitch from a first position to a second position;

a current supply that is arranged to supply the electromagnet with a current, and a detector system configured such that the movement of the electromagnet and therefore the actuator from the first position towards the second position ceases the supply of the current at a predetermined instant after the movement of the electromagnet and the actuator from the first to the second position, thereby releasing the magnetic element from the electromagnet such that the door is released from the closed position.

2. The device as claimed in claim 1, wherein the device further comprises a visual indication when the electromagnet is generating the magnetic field.

3. The device as claimed in claim 1, wherein the body comprises:

an elongate section that defines a void; and elements that extend outwardly from opposed surfaces of the elongate section and into the void, wherein the electromagnet is located in the void.

4. The device as claimed in claim 3, wherein the coupling device comprises:

a base that is retained in position by the elements;

a component that is secured to the main part and which is attached to the base; and a resilient part disposed between the base and head of the component, the resilient part being such that it enables the movement of the electromagnet.

5. The device as claimed in claim 1, wherein the detector system further comprises an adjustable portion that can be adjusted so as to set an amount of the movement of the electromagnet that causes the change in the state of the actuator.

6. The device as claimed in claim 1, further comprising a CCD camera arranged to capture an image subsequent to the current supply detecting the movement of the electromagnet.

7. The device as claimed in claim 1, further comprising a sound emitting device arranged to emit a sound subsequent to the current supply detecting the movement of the electromagnet.

8. The device as claimed in claim 1, further comprising an audio recorder arranged to record audio information.

9. The device as claimed in claim 1, further comprising a radio frequency transmitter that is arranged to transmit a radio signal encoded with at least one of an image captured by an image capture device or audio information recorded by an audio recorder.

10. The device as claimed in claim 8, further comprising a radio frequency transmitter that is arranged to transmit a radio signal encoded with at least one of an image captured by a CCD camera or the audio information recorded by the audio recorder.

11. The device as claimed in claim 1, wherein the body is mountable to a stationary door frame mounting the door to a doorway, and the magnetic element is a door armature plate mountable to the door, such that the electromagnet securely retains the door armature plate when the door armature plate is in abutment with the electromagnet, and the electromagnet is generating the magnetic field.

12. The device as claimed in claim 11, wherein movement of the door from the closed position towards the opened position causes the door armature plate to cause the electromagnet to move from the first position to the second position relative to the body.

13. The device as claimed in claim 1, further comprising an electronic timer circuit electronically coupled to the detector and the current supply to determine the predetermined instant after which the current supply ceases to supply the current.

* * * * *